US006030763A

United States Patent [19]

Mifune

[11] Patent Number: 6,030,763

[45] Date of Patent: Feb. 29, 2000

[54] PROCESS FOR REDUCTION-SENSITIZING SILVER HALIDE PHOTOGRAPHIC EMULSION AND SILVER HALIDE PHOTOGRAPHIC LIGHT-SENSITIVE MATERIAL USING THE SAME

[75] Inventor: Hiroyuki Mifune, Kanagawa, Japan

[73] Assignee: Fuji Photo Film Co., Ltd., Kanagawa, Japan

[21] Appl. No.: 09/059,411

[22] Filed: Apr. 14, 1998

[30] Foreign Application Priority Data

Apr. 14, 1997 [JP] Japan ..... 9-096249
May 19, 1997 [JP] Japan ..... 9-128995

[51] Int. Cl.[7] ..... G03C 1/015; G03C 1/035; G03C 1/09

[52] U.S. Cl. ..... 430/567; 430/569; 430/599; 430/603; 430/605

[58] Field of Search ..... 430/567, 569, 430/599, 603, 605

[56] References Cited

U.S. PATENT DOCUMENTS

| | | | |
|---|---|---|---|
| 3,957,490 | 5/1976 | Libeer et al. | 430/569 |
| 5,114,838 | 5/1992 | Yamada | 430/569 |
| 5,254,456 | 10/1993 | Yamashita et al. | 430/611 |
| 5,368,999 | 11/1994 | Makino | 430/569 |
| 5,500,333 | 3/1996 | Eikenberry et al. | 430/567 |
| 5,512,427 | 4/1996 | Maskasky | 430/567 |
| 5,723,277 | 3/1998 | Nabeta | 430/567 |
| 5,851,751 | 12/1998 | Wallis et al. | 430/567 |

*Primary Examiner*—Mark F. Huff
*Attorney, Agent, or Firm*—Sughrue, Mion, Zinn, Macpeak & Seas, PLLC

[57] ABSTRACT

A process for reduction-sensitizing a silver halide photographic emulsion is disclosed, comprising reduction-sensitizing a silver halide basis grain having a silver bromide content of 75 mol % or more and thereafter or at the same time, depositing silver halide having a silver chloride content of 50 mol % or more on the surface of said basis grain not to have a distinct epitaxial form. Further disclosed is a silver halide photographic light-sensitive material containing a silver halide emulsion prepared by the process.

15 Claims, No Drawings

PROCESS FOR REDUCTION-SENSITIZING SILVER HALIDE PHOTOGRAPHIC EMULSION AND SILVER HALIDE PHOTOGRAPHIC LIGHT-SENSITIVE MATERIAL USING THE SAME

FIELD OF THE INVENTION

The present invention relates to a process for reduction-sensitizing a silver halide photographic emulsion, more specifically, the present invention relates to a process for reduction-sensitizing a silver halide photographic emulsion having high sensitivity and low fog and at the same time, improved storability, and to a silver halide photographic light-sensitive material containing a silver halide emulsion prepared by the process.

BACKGROUND OF THE INVENTION

In recent years, the silver halide photographic light-sensitive materials are more and more strictly required to have high sensitivity, excellent graininess, superior gradation, high sharpness, good storability or suitability for rapid processing of development rate. In particular, a demand for still higher sensitivity while suppressing the fog low and keeping good storability is strong.

The silver halide emulsion is usually subjected to chemical sensitization using various chemical substances so as to obtain desired sensitivity and gradation.

Specific examples of the chemical sensitization include chalcogen sensitization such as sulfur sensitization, selenium sensitization and tellurium sensitization, noble metal sensitization using a noble metal such as gold, and reduction sensitization using a reducing agent. These sensitization methods are used individually or in combination.

With respect to the time for performing the reduction sensitization, the time of forming silver halide grains has been studied as described, for example, in JP-A-48-87825 (the term "JP-A" as used herein means an "unexamined published Japanese patent application"), JP-A-50-3619 and European Unexamined Patent Publication Nos. 348934A, 369491A, 371388A, 396424A, 404142A and 435355A.

In the reduction sensitization of these publications, reducing compounds described in T. H. James, *The Theory of the Photographic Process,* Chap. 5, Macmillan (1977), P. Grafikides, *Chimie et Physique Photographique,* 5th ed., Paul Montel (1987), and *Research Disclosure,* vol. 307, No. 307105 have been predominantly used. Specific examples of the reducing compound include aminoiminomethanesulfinic acid (also called thiourea dioxide), borane compounds (e.g., dimethylaminoborane), hydrazine compounds (e.g., hydrazine, p-tolylhydrazine), polyamine compounds (e.g., diethyltriamine, tiethylenetetramine), stannous chloride, silane compounds, reductones (e.g., ascorbic acid), sulfite, formaldehyde and hydrogen gas.

Further, it has also been studied to perform reduction sensitization after forming the silver halide grains and in this case, in addition to the use of the above-described reduction sensitizer (i.e., reducing compounds), an attempt has been made to reduction-sensitize the surface of a silver halide grain using a reduction sensitizer described in JP-A-8-272024 and U.S. Pat. No. 5,500,333.

The sensitization center (i.e., nuclei of sensitization) of yielding high sensitivity by the reduction sensitization is considered to be a small silver nucleus which is very readily changed by aging particularly under the conditions of allowing the presence of moisture and air. This is the reason for poor storability of the silver halide emulsion subjected to reduction sensitization and also for the tendency of fog to worsen. The small silver nucleus is produced inside a silver halide grain but the silver nucleus cannot be completely fixed to that position and along the deposition of silver halide thereon, a fairly large part of the silver core comes out to the grain surface and may readily cause fog or give rises to poor storability.

Accordingly, in order to control the silver nucleus which readily causes fog, an oxidizing agent such as thiosulfinic acid or disulfide compound is used together as described in some patent publications described above, however, if the oxidizing agent is used too much, there arise problems that the sensitivity is reduced or the latent image is liable to regress.

Under these circumstances, it is keenly demanded to improve storability and fog while maintaining the high sensitivity of the silver halide emulsion subjected to reduction sensitization.

SUMMARY OF THE INVENTION

A first object of the present invention is to provide a reduction sensitizing process for obtaining a high-speed silver halide photographic emulsion.

A second object of the present invention is to provide a reduction sensitizing process for obtaining a high-speed silver halide photographic emulsion having good storability.

A third object of the present invention is to provide a silver halide photographic light-sensitive material having good storability using a high-speed silver halide photographic emulsion reduced in the fog.

The above-described objects have been attained by a process for reduction-sensitizing a silver halide photographic emulsion, comprising reduction-sensitizing a silver halide basis grain having a silver bromide content of 60 mol % or more and thereafter or at the same time, depositing silver halide having a silver chloride content of 50 mol % or more on the surface of the basis grain not to have a distinct epitaxial form, and by a silver halide photographic light-sensitive material containing at least one silver halide photographic emulsion prepared by the above process.

DETAILED DESCRIPTION OF THE INVENTION

The present invention is described in detail below.

The silver halide grain serving as a basis on performing the reduction sensitization is a silver halide grain comprising silver bromide, silver iodobromide, silver chlorobromide or silver chloroiodobromide, preferably silver bromide, silver iodobromide or silver chloroiodobromide, having a silver bromide content of 60 mol % or more.

The silver bromide content is preferably 75 mol % or more. The silver iodide content is from 0 to 25 mol %, preferably from 0 to 20 mol %, more preferably from 1 to 20 mol %. The silver chloride content exclusive of the high silver chloride content to be deposited is from 0 to 30 mol %, preferably from 0 to 20 mol %.

The grain may have a regular crystal form such as cubic, octahedral or tetradecahedral, a tabular crystal form, a spherical crystal form or a composite form of these crystal grain forms. Of these, a regular crystal grain and a tabular crystal grain are preferred, and a tabular grain having an aspect ratio of 2 or more is more preferred.

The silver halide grain grown by depositing a high silver chloride after or during the reduction sensitization and further depositing thereon silver halide also preferably has a shape as described above.

The silver halide comprising 60 mol % or more of silver bromide may be reduction-sensitized in an atmosphere of high pH or of low pAg in excess silver ion region called silver ripening or using a reducing compound described in JP-A-8-272024 and U.S. Pat. No. 5,500,333 such as aminoiminomethanesulfinic acid (also called thiourea dioxide), borane compounds (e.g., dimethylaminoborane), hydrazine compounds (e.g., hydrazine, p-tolylhydrazine), polyamine compounds (e.g., diethyltriamine, tiethylenetetramine), stannous chloride, silane compounds, reductones (e.g., ascorbic acid), sulfite, formaldehyde and hydrogen gas.

The reduction sensitization is preferably performed in an atmosphere of high pH and low pAg, and using a compound described in JP-A-8-272024 such as aminoiminomethanesulfinic acid (also called thiourea dioxide), borane compounds (e.g., dimethylaminoborane), polyamine compounds (e.g., diethyltriamine, tiethylenetetramine), stannous chloride or reductones (e.g., ascorbic acid), more preferably in an atmosphere of high pH and low pAg and using aminoiminomethanesulfinic acid (also called thiourea dioxide), borane compounds (e.g., dimethylaminoborane), polyamine compounds (e.g., diethyltriamine, tiethylenetetramine) or reductones (e.g., ascorbic acid).

The silver halide (i.e., high silver chloride) to be deposited during or after the reduction sensitization has a silver chloride content of 50 mol % or more, preferably 75 mol % or more, more preferably 90 mol % or more, and pure silver chloride is most preferred. The high silver chloride has a silver bromide content of 50 mol % or less, preferably 25 mol % or less, more preferably 10 mol % or less, and a silver iodide content of preferably 5 mol % or less, more preferably 1 mol % or less. This high silver chloride may be a fine grain high silver chloride previously prepared, or a solution of silver nitrate and a water-soluble chloride may be added, however, the fine grain high silver chloride is preferred.

The high silver chloride deposited accounts for 0.3 wt % or more, preferably 0.5 wt % or more, more preferably 1.5 wt % or more and at the same time, 20 wt % or less, more preferably 10 wt % or less, of the entire silver amount. The high silver chloride deposited most preferably accounts for preferably from 0.5 to 10 wt % and more preferably from 0.5 to 5.0 wt % of the entire amount.

The high silver chloride does not exhibit a distinct epitaxial form when it is deposited on the basis grain. More specifically, the high silver chloride is not deposited only on a specific position such as corners or sides of the basis grain but preferably deposited to extensively cover 30% or more, preferably 50% or more, more preferably 60% or more, of the basis grain surface even with irregularities. To this effect, the high silver chloride is more preferably deposited after performing the reduction sensitization but before adding an absorptive compound such as a dye.

The grain after high silver chloride is deposited may be used as it is, however, silver bromide, silver iodobromide, silver chlorobromide or silver chloroiodobromide having a silver bromide content of 60 mol % or more, as described above, may further be deposited thereon to form a silver halide grain.

In other words, the reduction sensitization is performed at the grain formation and simultaneously high silver chloride is interposed during the grain formation.

Conventional processes also disclose a technique of incorporating high silver chloride into a silver halide grain having a high silver bromide content at the preparation thereof, however, the technique is by no means referred to the case where incorporation of high silver chloride is carried out when reduction sensitization is performed. Further, although it is known to create a distinct epitaxial form by the high silver chloride, the effect obtained by depositing the high silver chloride not to have a distinct form is not known. In particular, conventional techniques are completely silent on the advantageous effect as verified in the Examples described later, which can be attained by depositing the high silver chloride after or during the reduction sensitization as in the present invention. The effect is an amazingly unexpected effect and considered to be brought out because the small silver nucleus as the reduction sensitization nucleus produced is stabilized by the deposition of high silver chloride and can be readily fixed to the neighborhood of the position produced.

The production process of the silver halide emulsion can be roughly divided into the grain formation step, the desalting step and the chemical sensitization step. The grain formation consists of nucleation, ripening and growing. These steps are not performed uniformly but the order of the steps may be reversed or a step may be repeatedly performed. The silver halide emulsion can be fundamentally subjected to reduction sensitization in any step before or during chemical sensitization step. The reduction sensitization may be performed at the initial stage of the grain formation such as at the nucleation or physical ripening, at the growing step or in advance of chemical sensitization other than the reduction sensitization. The term "chemical sensitization" as used herein means chemical sensitization exclusive of reduction sensitization. In the case where chemical sensitization using gold sensitization in combination is performed, the reduction sensitization is preferably performed in advance of the chemical sensitization so as not to generate disadvantageous fog.

The reduction sensitization of the present invention may be performed during the formation of silver halide grains or after the grain formation, however, it is preferably performed during the growing of silver halide grains. The term "during the growing of silver halide grains" as used herein means that a method of performing reduction sensitization in the state where the silver halide grains are growing by the physical ripening or addition of a water-soluble silver salt and a water-soluble alkali halide and a method of performing reduction sensitization in the state where the growing is once stopped during the growing step and thereafter the growing is further continued are included.

In the case where the reduction sensitization is performed at the formation of silver halide grains, any time may be selected from the period between the starting of the formation of silver halide grains and immediately after the completion. The reduction sensitization is preferably performed at the time when the nucleation of silver halide grains is completed and when from 3 to 99 wt %, more preferably from 6 to 98 wt %, of the entire silver amount used for the nucleation is consumed. Also, the reduction sensitization may be performed by adding the reducing agent in two or more installments or may be performed continuously.

The amount used of the reduction sensitizer for use in the present invention varies depending on the silver halide grain or chemical sensitization conditions used, however, it may be from $10^{-8}$ to $10^{-2}$ mol, preferably approximately from $10^{-7}$ to $10^{-3}$ mol, per mol of silver halide.

The conditions for the reduction sensitization of the present invention are not particularly limited, however, pAg is from 5 to 11, preferably from 6 to 10, the pH is from 3 to 10, preferably from 4 to 8, and the temperature is from 40 to 95° C., preferably from 45 to 85° C.

The reduction sensitizer for use in the present invention may be dissolved in water or an appropriate organic solvent which can be mixed with water and does not adversely affect the photographic properties, such as alcohols, glycol, ketones, esters and amides, and used as a solution or a solid dispersion.

In the present invention, an oxidizing agent for silver is preferably added unless any problem arises, and examples of the oxidizing agent include thiosulfonates (e.g., sodium benzenethiosulfonate, sodium ethanethiosulfonate), iodine and dichalcogen compounds, with thiosulfonates being preferred.

The silver halide emulsion subjected to reduction sensitization of the present invention is preferably further subjected to chalcogen sensitization such as sulfur sensitization, selenium sensitization or tellurium sensitization, or to noble metal sensitization, and these sensitization methods may be used individually or in combination.

In the sulfur sensitization, a labile sulfur compound is used and the labile sulfur compounds described in P. Grafkides, *Chimie et Physique Photograpique,* 5th ed., Paul Montel (1987) and *Research Disclosure,* vol. 307, No. 307105 may be used.

Specific examples thereof include well-known sulfur compounds such as thiosulfates (e.g., hypo), thioureas (e.g., 1,3-diphenylthiourea, triethylthiourea, N-ethyl-N'-(4-methyl-2-thiazolyl)thiourea, N-carboxymethyl-N,N',N'-trimethylthiourea), thioamides (e.g., thioacetamide), rhodanines (e.g., 3,5-diethyl rhodanine, 5-benzylidene-N-ethyl rhodanine), phosphine sulfides (e.g., trimethylphosphine sulfide), thiohydantoins, 4-oxo-oxazolidine-2-thiones, disulfides, polysulfoxides (e.g., lenthionine), polythionates and elemental sulfur, and active gelatin. Among these, preferred are hypo, thioureas, rhodanines and phosphine sulfides.

In the selenium sensitization, a labile selenium compound may be used and the compounds described in U.S. Pat. Nos. 3,297,446 and 3,297,447, JP-A-4-25832, JP-A-4-109240, JP-A-4-147250, JP-A-4-271341, JP-A-5-40324, JP-A-5-224332, JP-A-5-224333, JP-A-5-11385, JP-A-6-43576, JP-A-6-75328, JP-A-6-175258, JP-A-6-175259, JP-A-6-180478, JP-A-6-208184 and JP-A-6-208186 are preferred.

Specific examples thereof include phosphine selenides (e.g., triphenylphosphine selenide, diphenyl (pentafluorophenyl)phosphine selenide), selenophosphates (e.g., tri-p-tolylselenophosphate), selenophosphinic acid esters, selenophosphonic acid esters, selenoureas (e.g., N,N-dimethylselenourea, N-acetyl-N,N',N'-trimethylselenourea, N-trifluoroacetyl-N,N',N'-trimethylselenourea), selenoamides (e.g., N,N-dimethylselenobenzamide, N,N-diethylselenobenzamide), selenoesters (e.g., p-methoxyselenobenzoic acid o-isopropyl ester, p-methoxyselenobenzoic acid Se-(3'-oxycyclohexyl) ester), diacylselenides (e.g., bis(2,6-dimethoxybenzoyl) selenide, bis(2,4-dimethoxybenzoyl) selenide), dicarbamoylselenides (e.g., bis(N,N-dimethylcarbamoyl) selenide), bis (alkoxycarbonyl) selenides (e.g., bis(n-butoxycarbonyl) selenide, bis(benzyloxycarbonyl) selenide), triselenones (e.g., 2,4,6-tris(p-methoxyphenyl)triselenone), diselenides, polyselenides, selenium sulfide, selenoketones, selenocarboxylic acid, isoselenocyanates and colloidal selenium. Among these, preferred are phosphine selenides, selenoamides, dicarbamoyl selenides, bis(alkoxycarbonyl) selenides and selenoesters Further, non-labile selenium compounds described in JP-B-46-4553 (the term "JP-B" as used herein means an "examined Japanese patent publication") and JP-B-52-34492, such as sodium selenite, potassium selenocyanate, selenazoles and selenides, may also be used.

In the tellurium sensitization, a labile tellurium compound is used and the labile tellurium compounds described in JP-A-4-224595, JP-A-4-271341, JP-A-4-333043, JP-A-5-303157, JP-A-6-27573, JP-A-6-175258, JP-A-6-180478, JP-A-6-208184, JP-A-6-208186, JP-A-6-317867, JP-A-7-140579, JP-A-7-301879 and JP-A-7-301880 may be used.

Specific examples thereof include phosphine tellurides (e.g., n-butyldiisopropylphosphine telluride, tri-isobutylphosphine telluride, tri-n-butoxyphosphine telluride, triisopropylphosphine telluride), diacyl (di) tellurides (e.g., bis(diphenylcarbamoyl) ditelluride, bis(N-phenyl-N-methylcarbamoyl) ditelluride, bis(N-phenyl-N-methylcarbamoyl) telluride, bis(N-phenyl-N-benzylcarbamoyl) telluride, bis-(ethoxycarbonyl)telluride), telluroureas (e.g., N,N'-dimethylethylenetellurourea), telluroamides and telluroesters. Among these, preferred are phosphine tellurides and diacyl (di)tellurides.

In the noble metal sensitization, salts of the noble metal described in P. Glafkides, *Chimie et Physique Photographique,* 5th ed., Paul Montel (1987) and *Research Disclosure,* vol. 307, No. 307105, such as gold, platinum, palladium and iridium, may be used, and the gold sensitization is particularly preferred. Specific example of the gold sensitizer include chloroauric acid, potassium chloroaurate, potassium aurithiocyanate, gold sulfide, gold selenide and the gold compounds described in U.S. Pat. Nos. 2,642,361, 5,049,484, 5,049,485, 5,169,751 and 5,252,455 and Belgian Patent 691,857.

When the silver halide grain of the present invention is the tabular grain, the selenium sensitization is preferably used as the chemical sensitization.

Among the selenium sensitization, the combination of the selenium sensitization and gold sensitization is particularly preferred.

These chemical sensitization methods may be used individually or in combination of two or more thereof. In the case of the combination use, a combination of chalcogen sensitization and gold sensitization is preferred and examples thereof include gold-sulfur sensitization, gold-sulfur-selenium sensitization, gold-sulfur-tellurium sensitization and gold-sulfur-selenium-tellurium sensitization.

The amount used of gold or chalcogen sensitizer for use in the present invention varies depending on the silver halide grain or chemical sensitization conditions used, however, it may be from $10^{-8}$ to $10^{-2}$ mol, preferably from $10^{-7}$ to $10^{-3}$ mol, per mol of silver halide.

The conditions for the chemical sensitization in the present invention are not particularly limited, however, the pAg is from 6 to 11, preferably from 7 to 10, the pH is from 4 to 10, preferably from 5 to 8, and the temperature is from 40 to 95° C., preferably from 45 to 85° C.

In the present invention, the chemical sensitization of silver halide is preferably performed in the presence of a silver halide solvent.

Specific examples of the silver halide solvent include thiocyanates (e.g., potassium thiocyanate), thioether compounds (e.g., the compounds described in U.S. Pat. Nos. 3,021,215, 3,271,157, JP-B-58-30571, JP-A-60-136739, particularly, 3,6-dithia-1,8-octanediol), tetra-substituted thiourea compounds (e.g., the compounds described in JP-B-59-11892 and U.S. Pat. No. 4,221,863, particularly tetramethylthiourea), thione compounds described in JP-B-60-1134, mercapto compounds described in JP-B-63-29727, mesoionic compounds described in JP-A-60-163042, selenoether compounds described in U.S. Pat. No. 4,782,013, telluroether compounds described in JP-A-2-118566 and sulfite. Among these, thiocyanates, thioether compounds, tetra-substituted thiourea compounds and thione compounds are preferred, and thiocyanates are more preferred. The amount of the silver halide solvent used is approximately from $10^{-5}$ to $10^{-2}$ mol per mol of silver halide.

The silver halide emulsion to be reduction-sensitized by the process of the present invention and the silver halide photographic light-sensitive material (sometimes simply referred to as "light-sensitive material") using the emulsion are described below. The above silver halide photographic light-sensitive material comprises a silver halide emulsion layer provided on a support.

The silver halide grain for use in the present invention as a final grain may have a multi-layer structure comprising two or more layers different in the iodide composition between the inside and the surface layer of the grain (e.g., internal high iodide grain or surface high iodide grain). Also, a grain in which the latent image is mainly formed on the surface thereof (e.g., negative emulsion) or a grain in which the latent image is mainly formed in the inside of the grain (e.g., internal latent image-type emulsion, previously fogged direct reversal-type emulsion) may be used, however, a grain in which the latent image is mainly formed on the surface is preferred.

The silver halide emulsion for use in the present invention contains, in terms of the final grain form, tabular silver halide grains having an aspect ratio of 2 or more, preferably tabular silver halide grains having an average aspect ratio of 3 or more, more preferably 5 or more. The tabular silver halide preferably occupies 60% or more of the entire projected area.

The tabular grain preferably has a diameter of from 0.15 to 5.0 $\mu$m and a thickness of from 0.02 to 1.0 $\mu$m, preferably from 0.03 to 0.5 $\mu$m, more preferably from 0.03 to 0.3 $\mu$m.

The average aspect ratio is obtained as an arithmetic average of the aspect ratios of individual grains determined at least on 100 silver halide grains.

In the case where the final grain has a regular crystal form or spherical form or a steric form, the diameter thereof is from 0.05 to 3 $\mu$m, preferably from 0.08 to 2 $\mu$m, and a monodisperse emulsion having a coefficient of variation of 20% or less, preferably 15% or less is more preferred.

The tabular grain as a final grain may have a (111) face or (100) face, as a main plane.

By using monodisperse tabular grains, further preferred effects are obtained. The structure and the production process of the monodisperse tabular grain are described, for example, in JP-A-63-151618, however, to state briefly here, 70% or more of the entire projected area of silver halide grains is occupied by tabular silver halide grains having a hexagonal shape with the ratio of the length of a side having a maximum length to the length of a side having a minimum length being 2 or less and having two parallel planes as the outer surfaces, and the tabular grains are monodisperse grains such that the coefficient of variation [a value obtained by dividing the distribution (standard deviation) of grain sizes represented by a diameter of a circle having the same area as the projected area of a grain by the average grain size] in the grain size distribution of the hexagonal tabular silver halide grains is 20% or less, preferably 15% or less.

In the present invention, the tabular grain preferably has a dislocation line. The dislocation line of the tabular grain can be observed by a direct method using a transmission-type electron microscope at a low temperature described, for example, in J. F. Hamilton, *Phot. Sci. Eng.,* 11, 57 (1967) and T. Shiozawa, *J. Soc. Phot. Sci. Japan,* 35, 213 (1972).

The number of dislocation lines is preferably 5 or more, more preferably 10 or more, per one grain. The tabular grain preferably has dislocation lines in the boundary part (fringe part).

That is, the silver halide tabular grains of the present invention is preferably improved in sensitivity by providing the dislocation lines.

At the formation of silver halide grains, a silver halide solvent may be used so as to control the growth of grains and examples thereof include ammonia, potassium thiocyanate, ammonium thiocyanate, thioether compounds (e.g., those described in U.S. Pat. Nos. 3,271,157, 3,574,628, 3,704,130, 4,297,439 and 4,276,374), thione compounds (e.g., those described in JP-A-53-144319, JP-A-53-82408 and JP-A-55-77737) and amine compounds (e.g., those described in JP-A-54-100717).

During the formation of silver halide grains or physical ripening, a ruthenium salt (e.g., hexacyanoruthenium), a zinc salt, chromium salt, an iridium salt or a complex salt thereof (e.g., iridium hexachloride), a rhodium salt or a complex salt thereof (e.g., rhodium hexachloride), or an iron salt or an iron complex salt (e.g., yellow prussiate of potash) may be present together. Among these, an iridium salt, an iron salt and a rhodium salt are preferred.

Gelatin is advantageous as a binder or a protective colloid for use in the emulsion layer or interlayer of the photographic light-sensitive material, however, other hydrophilic colloids may also be used. Examples thereof include proteins such as gelatin derivatives, graft polymers of gelatin with other polymers, albumin and casein; saccharide derivatives such as cellulose derivatives (e.g., hydroxyethyl cellulose, carboxymethyl cellulose, cellulose sulfate), sodium alginate and starch derivatives; and various synthetic hydrophilic polymer materials such as homopolymers and copolymers of polyvinyl alcohol, polyvinyl alcohol partial acetal, poly-N-vinylpyrrolidone, polyacrylic acid, polymethacrylic acid, polyacrylamide, polyvinyl imidazole or polyvinyl pyrazole.

The tabular grain for use in the present invention may be prepared by the method described in Cleve, *Photography Theory and Practice,* p. 131 (1930); Gutoff, *Photographic Science and Engineering,* vol. 14, pp. 248–257 (1970); U.S. Pat. Nos. 4,434,226, 4,414,310, 4,433,048 and 4,439,520, and British Patent 2,112,157.

The gelatin may be a general-purpose lime-processed gelatin, an acid-processed gelatin or an enzyme-processed gelatin as described in *Bull. Soc. Photo. Japan,* No. 16, p. 30 (1966), and a hydrolysate of gelatin may also be used.

The photographic light-sensitive material may contain an inorganic or organic hardening agent in any hydrophilic colloid layer constituting the photographic light-sensitive layer or back layer. Specific examples thereof include chromium salts, aldehyde salts (e.g., formaldehyde, glyoxal, glutaraldehyde) and N-methylol-base compounds (e.g., dimethylolurea). Further, active halogen compounds (e.g., 2,4-dichloro-6-hydroxy-1,3,5-triazine and a sodium salt thereof) and active vinyl compounds (e.g., 1,3-bisvinylsulfonyl-2-propanol, 1,3-bis(vinylsulfonylacetamide)ethane, bis(vinylsulfonylmethyl) ether, vinyl-base polymer having a vinylsulfonyl group on the side chain thereof) are preferred because the hydrophilic colloid such as gelatin can be rapidly hardened and stable photographic properties can be obtained. Furthermore, N-carbamoylpyridinium salts (e.g., (1-morpholinocarbonyl-3-pyridinio)methanesulfonate) and haloamidinium salts (e.g., 1-(1-chloro-l-pyridinomethylene)pyrrolidinium-2-naphthalenesulfonate) also have an excellent effect of realizing rapid hardening.

The silver halide photographic emulsion for use in the present invention is preferably spectrally sensitized with a methine dye or the like. Examples of the dye which can be used include a cyanine dye, a merocyanine dye, a complex cyanine dye, a complex merocyanine dye, a holopolar cyanine dye, a hemicyanine dye, a styryl dye and a hemioxonol dye. Among these, particularly useful are dyes belonging to the cyanine dye, the merocyanine dye and the complex merocyanine dye. The cyanine dye is particularly preferred. To these dyes, any nucleus commonly used for cyanine dyes as a basic heterocyclic nucleus can be applied. Examples of the nucleus include pyrroline nucleus, oxazoline nucleus, thiazoline nucleus, pyrrole nucleus, oxazole nucleus, thiazole nucleus, selenazole nucleus, imidazole nucleus, tetrazole nucleus and pyridine nucleus; a nucleus resulting from fusing of an alicyclic hydrocarbon ring to the above-described nucleus; and a nucleus resulting from fusing of an aromatic hydrocarbon ring to the above-described nucleus, e.g., indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus and quinoline nucleus. These nuclei may have a substituent on the carbon atom thereof.

To the merocyanine dye or complex merocyanine dye, a 5- or 6-membered heterocyclic nucleus such as pyrazolin-5-one nucleus, thiohydantoin nucleus, 2-thioxazolidine-2,4-dione nucleus, thiazolidine-2,4-dione nucleus, rhodanine nucleus and thiobarbituric acid nucleus, may be applied as a nucleus having a ketomethylene structure.

These sensitizing dyes may be used individually or in combination and the combination of sensitizing dyes is often used for the purpose of supersensitization. Together with a sensitizing dye, a dye which by itself does not have a spectral sensitization effect or a material which absorbs substantially no visible light, but exhibits supersensitization, may be incorporated into the emulsion. Examples thereof include aminostilbene compounds substituted by a nitrogen-containing heterocyclic nucleus group (e.g., those described in U.S. Pat. Nos. 2,933,390 and 3,635,721), aromatic organic acid formaldehyde condensate (e.g., those described in U.S. Pat. Nos. 3,743,510), cadmium salts and azaindene compounds. The combinations described in U.S. Pat. Nos. 3,615,613, 3,615,641, 3,617,295 and 3,635,721 are particularly useful.

The silver halide photographic emulsion for use in the present invention may contain various compounds so as to prevent fogging or stabilize the photographic capabilities during preparation, storage or photographic processing of the light-sensitive material. More specifically, a large number of compounds known as an antifoggant or stabilizer may be added. Examples thereof include azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole); mercaptopyrimidines; mercaptotriazines; thioketo compounds such as oxazolinethione; azaindenes such as triazaindenes, tetrazaindenes (in particular, 4-hydroxy-6-methyl(1,3,3a,7)tetrazaindenes) and pentazaindenes; benzenethiosulfonic acid, benzenesulfinic acid and benzenesulfinic acid amide.

The photographic light-sensitive material may contain one or more surface active agents as a coating aid or an antistatic agent or for improving sliding property or emulsion dispersion, preventing adhesion or improving photographic properties (e.g., development acceleration, increase of contrast, sensitization).

The photographic light-sensitive material may contain a water-soluble dye in the hydrophilic colloid layer as a filter dye or for preventing irradiation or halation or other various purposes. Preferred examples of this dye include oxonol dyes, hemioxonol dyes, styryl dyes, merocyanine dyes, anthraquinone dyes and azo dyes. Other than these dyes, cyanine dyes, azomethine dyes, triarylmethane dyes and phthalocyanine dyes are useful. Also, an oil-soluble dye may be added to the hydrophilic colloid layer after emulsifying it by the oil-in-water dispersion method.

The photographic light-sensitive material may be constructed as a multi-layer multicolor photographic light-sensitive material having at least two different spectral sensitivities on the support.

The multi-layer natural color photographic material usually has at least one red-sensitive emulsion layer, at least one green-sensitive emulsion layer and at least one blue-sensitive emulsion layer on the support. The arrangement order of these layers may be freely selected according to the purpose. The preferred arrangement includes the order of a red-sensitive layer, a green sensitive layer and a blue-sensitive layer from the support side, the order of a blue-sensitive layer, a green-sensitive layer and a red-sensitive layer from the support side, and the order of a blue-sensitive layer, a red-sensitive layer and a green-sensitive layer from the support side. Further, any emulsion layer having the same color sensitivity may be constituted by two or more emulsion layers different in the sensitivity to increase the ultimate sensitivity. A three-layer structure may also be used to improve the graininess. Furthermore, a light-insensitive layer may be present between two or more emulsion layers having the same color sensitivity or an emulsion layer having different color sensitivity may be interposed between the emulsion layers having the same color sensitivity. Still further, a reflection layer containing fine grain silver halide may be provided under the high-sensitive layer, particularly under the high-speed blue-sensitive layer, to increase the sensitivity.

The additives used in the silver halide emulsion for use in the present invention are described in Research Disclosure, Nos. 17643, 18716 and 307105, and the pertinent portions are summarized in the table below.

| Kinds of Additives | RD17643 (December, 1978) | RD18716 (November, 1979) | RD307105 (November, 1989) |
|---|---|---|---|
| 1. Chemical sensitizer | p. 23 | p. 648, right col. | p. 866 |
| 2. Sensitivity increasing agent | | p. 648, right col. | |

-continued

| Kinds of Additives | RD17643 (December, 1978) | RD18716 (November, 1979) | RD307105 (November, 1989) |
|---|---|---|---|
| 3. Spectral sensitizer, supersensitizer | pp. 23–24 | p. 648, right col.–p. 649, right col. | pp. 866–868 |
| 4. Brightening agent | p. 24 | p. 647, right col. | p. 868 |
| 5. Antifoggant, stabilizer | pp. 24–25 | p. 649, right col. | pp. 868–870 |
| 6. Light absorbent, filter dye, UV absorbent | pp. 25–26 | p. 649, right col.–p. 650, left col. | p. 873 |
| 7. Stain inhibitor | p. 25, right col. | p. 650, left to right col. | p. 872 |
| 8. Dye image stabilizer | p. 25 | p. 650, left col. | p. 872 |
| 9. Hardening agent | p. 26 | p. 651, left col. | pp. 874–875 |
| 10. Binder | p. 26 | p. 651, left col. | pp. 873–874 |
| 11. Plasticizer, lubricant | p. 27 | p. 650, right col. | p. 876 |
| 12. Coating aid, surface active agent | pp. 26–27 | p. 650, right col. | pp. 875–876 |
| 13. Antistatic agent | p. 27 | p. 650, right col. | pp. 876–877 |
| 14. Matting agent | | | pp. 878–879 |

Other techniques and inorganic or organic materials which can be used in the photographic light-sensitive material for use in the present invention are described in the following portions of European Unexamined Patent Publication No. 436938A2 or in the patents described below.

1. Layer structure: from p. 146, line 34 to p. 147, line 25
2. Yellow coupler: from p. 137, line 35 to p. 146, line 33, and p. 149, lines 21 to 23
3. Magenta coupler: from p. 149, lines 24 to 28: and from p. 3, line 5 to p. 25, line 55 of European Unexamined Patent Publication No. 421453A1
4. Cyan coupler: from p. 149, lines 29 to 33; and from p. 3, line 28 to p. 40, line 2 of European Unexamined Patent Publication No. 432804A2
5. Polymer coupler: p. 149, lines 34 to 38; and from p. 113, line 39 to p. 123, line 37 of European Unexamined Patent Publication No. 435334A2
6. Colored coupler: from p. 53, line 42 to p. 137, line 34, and p. 149, lines 39 to 45
7. Other functional coupler: from p. 7, line 1 to p. 53, line 41, and p. 149, line 46 to p. 150, line 3; and from p. 3, line 1 to p. 29, line 50 of European Unexamined Patent Publication No. 435334A2
8. Antiseptic and antifungal: p. 150, lines 25 to 28 9. Formalin scavenger: p. 149, lines 15 to 17
10. Other additives: p. 153, lines 38 to 47; and from p. 75, line 21 to p. 84, line 56, and from p. 27, line 40 to p. 37, line 40 of European Unexamined Patent Publication No. 421453A1
11. Dispersion method: p. 150, lines 4 to 24
12. Support: p. 150, lines 32 to 34
13. Thickness and physical properties of layers: p. 150, lines 35 to 49
14. Color development: p. 150, line 50 to p. 151, line 47
15. Desilvering: p. 151, line 48 to p. 152, line 53
16. Automatic developing machine: p. 152, line 54 to p. 153, line 2
17. Water washing and stabilization: p. 153, lines 3 to 37

Preferred embodiments of the present invention are described below.

(1) A process for reduction-sensitizing a silver halide photographic emulsion, comprising reduction-sensitizing a silver halide grain comprising at least one selected from silver bromide, silver iodobromide, silver chlorobromide or silver chloroiodobromide having a silver bromide content of 60 mol % or more and thereafter or at the same time, depositing silver halide having a silver chloride content of 50 mol % or more and not having a distinct epitaxial form.

(2) The process for reduction-sensitizing a silver halide photographic emulsion as described in (1), wherein the high silver chloride deposited is a fine grain high silver chloride grain previously prepared.

(3) The process for reduction-sensitizing a silver halide photographic emulsion as described in (1), wherein after the high silver chloride is deposited, silver bromide, silver iodobromide, silver chlorobromide or silver chloroiodobromide having a silver bromide content of 60 mol % or more is further deposited to form a silver halide grain.

(4) The process for reduction-sensitizing a silver halide photographic emulsion as described in (3), wherein a final grain is a tabular grain having an aspect ratio of 2 or more.

(5) The process for reduction-sensitizing a silver halide photographic emulsion as described in (1), wherein the silver halide grain comprising at least one selected from silver bromide, silver iodobromide, silver chlorobromide or silver chloroiodobromide having a silver bromide content of 60 mol % or more is a tabular grain having an aspect ratio of 2 or more.

(6) The process for reduction-sensitizing a silver halide photographic emulsion as described in (1), which is performed in an atmosphere of high pH or of low pAg in the silver ion excessive region called silver ripening or using an aminoiminemethanesulfinic acid (also called thiourea dioxide), a borane compound such as dimethylaminoborane, an amine compounds such as diethyltriamine, stannous chloride, a reductone compound such as ascorbic acid or a compound described in JP-A-8-272024.

(7) The process for reduction-sensitizing a silver halide photographic emulsion as described in (1), wherein the high silver chloride deposited has a silver chloride content of 75 mol % or more, preferably 90 mol % or more, and more preferably it is the silver chloride.

(8) The process for reduction-sensitizing a silver halide photographic emulsion as described in (1), wherein the high silver chloride deposited accounts for 0.3 wt % or more, preferably 0.5 wt % or more, more preferably 1.5 wt % or more and at the same time, 10 wt% or less, of the entire silver amount, and the high silver chloride deposited accounts for more preferably 0.5 to 10 wt %, most preferably from 0.5 to 5 wt % of the entire silver amount.

(9) After the reduction sensitization of the present invention is performed, the silver halide photographic emulsion is subjected to chalcogen sensitization using sulfur, selenium or tellurium.

(10) After the reduction sensitization of the present invention is performed, the silver halide photographic emulsion is subjected to gold sensitization.

(11) After the reduction sensitization of the present invention is performed, the silver halide photographic emulsion is subjected to chemical sensitization comprising a combination of chalcogen sensitization using sulfur, selenium or tellurium with gold sensitization.

(12) The silver halide photographic emulsion subjected to the reduction sensitization of the present invention is subjected to spectral sensitization by adding a methine dye.

(13) In (11), the methine dye is a cyanine dye.

(14) In (4) or (5), the tabular grain having an aspect ratio of 2 or more is a hexagonal tabular grain having (111) face as the main plane.

(15) In (4) or (5), the tabular grain having an aspect ratio of 2 or more is a hexagonal tabular grain having (100) face as the main plane.

(16) The grain subjected to reduction sensitization of the present invention has 5 or more dislocation lines per one grain.

(17) A silver halide photographic light-sensitive material comprising at least one silver halide emulsion prepared by the reduction sensitization process described in (1).

The present invention will be described below in greater detail by referring to the Examples but it should not be construed as being limited to these examples.

EXAMPLE 1

(Em-1)

To 1 liter of an aqueous solution containing 0.35 g of potassium bromide and 40 g of gelatin, kept at 75° C. and having a pH of 5, an aqueous silver nitrate solution ($AgNO_3$: 18 g) and an aqueous potassium bromide solution (KBr: 12.7 g) were simultaneously added over 20 minutes while stirring (first stage). After 5 minutes, an aqueous silver nitrate solution ($AgNO_3$: 76 g) and an aqueous potassium bromide solution (70 g) were simultaneously added thereto over 15 minutes by the flow rate acceleration method where the final addition flow rate was increased to 4 times the initial rate, while keeping the silver potential at −10 mV to the saturated calomel electrode (second stage).

After 10 minutes, an aqueous silver nitrate solution ($AgNO_3$: 76 g) and an aqueous potassium bromide solution (70 g) were simultaneously added thereto over 10 minutes by the flow rate acceleration method where the final addition flow rate was increased to 3 times the initial rate, while keeping the silver potential at −25 mV (third stage).

After completion of the grain formation, the resulting emulsion was desalted by normal flocculation and washed with water and then thereto gelatin and water were added to adjust the pH to 6.3 and the pAg to 8.8. The silver bromide emulsion obtained was a monodispersed octahedral emulsion (Em-1) having a grain diameter of 0.42 μm and a coefficient of variation in the grain diameter of 9.5%.

(Em-2)

Em-2 was obtained in the same manner as in Em-1 except that 3 minutes after completion of the addition at the two stage in the preparation of Em-1, silver chloride fine grain emulsion having a side length of 0.11 μm was added as shown in Table 1 below.

(Em-3)

Em-3 was obtained in the same manner as in Em-1 except that 1 minute before initiation of the addition at the second stage in the preparation of Em-1, NaOH was added to adjust the pH to 9.2 and 1 minute after completion of the addition at the second stage in the preparation of Em-1, $H_2SO_4$ was added to return the pH to 5.0. That is, the reduction sensitization at the second stage was performed at a high pH.

(Em-4 to Em-6)

Em-4 to Em-6 were obtained in the same manner as in Em-3 except that 2 minutes after the adjustment of the pH from 9.2 to 5.0 performed 1 minute after completion of the second stage addition in the preparation of Em-3, a previously prepared silver chloride fine grain emulsion having a side length of 0.11 μm was added as shown in Table 1 below.

In Em-6, when the grain immediately before the starting of the third stage was observed through an electron microscope, gentle and rounded projections or recessions were slightly observed over the entire surface.

The silver bromide emulsions obtained were almost the same as in Em-1 with respect to the grain diameter, the coefficient of variation of the grain diameter, and the shape.

The emulsions obtained each was ripened for 40 minutes by elevating the temperature to 60° C. and adding chloroauric acid ($0.1\times10^{-5}$ mol/mol-Ag), sodium thiosulfate ($1.6\times10^{-5}$ mol/mol-Ag), pentafluorophenyldiphenylphosphine selenide ($0.4\times10^{-5}$ mol/mol-Ag) and potassium thiocyanate ($2\times10^{-3}$ mol/mol-Ag).

Thereafter, gelatin, 4-hydroxy-6-methyl-1,3,3a,7-tetrazaindene, sodium polystyrenesulfonate, phenoxyethanol and sodium dodecylbenzenesulfonate were added to each emulsion and the resulting emulsion was coated on a triacetyl cellulose film support having an undercoat layer, together with the protective layer containing gelatin, polymethyl methacrylate particles and 1,2-bis(vinylsulfonylacetylamino)ethane by the co-extrusion method.

The samples obtained each was exposed (1/100 sec) using a sensitometry through an optical wedge, developed at 20° C. for 10 minutes with the developer MAA-1 having the following formulation and then subjected to stopping, fixing, water washing and drying in a usual manner. Then, the density was measured.

The relative sensitivity was a reciprocal of the exposure amount necessary for obtaining an optical density of (fog value+0.2), relativized to the value of Sample 1 which was taken as 100.

TABLE 1

| Sample | Em | Experience of pH being 9.2 | Amount of Silver Chloride Fine Grain (g) (in terms of $AgNO_3$) | Immediately after Coating: Fog | Immediately after Coating: Relative Sensitivity | Change Rate of Relative Sensitivity after Storage at 45° C. and 75% RH | |
|---|---|---|---|---|---|---|---|
| 1 | Em-1 | none | — | 0.10 | 100 | 83 | Comparison |
| 2 | Em-2 | " | 8.5 | 0.10 | 103 | 85 | " |
| 3 | Em-3 | done | — | 0.28 | 191 | 61 | " |
| 4 | Em-4 | " | 0.9 | 0.18 | 202 | 76 | Invention |
| 5 | Em-5 | " | 2.6 | 0.11 | 210 | 88 | " |
| 6 | Em-6 | " | 8.5 | 0.11 | 206 | 81 | " |

| Developer MAA-1 | |
|---|---|
| Metol | 2.5 g |
| Ascorbic acid | 10 g |
| NABOX | 35 g |
| Potassium bromide | 1 g |
| Water to make | 1 l |

Further, each sample was stored for 5 days under high temperature and high humidity conditions of 45° C. and 75% RH (relative humidity) and then processed in the same manner as above. The relative sensitivity was determined and the ratio of change from that immediately after the coating was obtained for each sample. The storability was evaluated based on the results.

As is apparent from the results of Table 1, when reduction sensitization was performed during the formation of silver halide grains in a high pH atmosphere, the sensitivity was extremely increased after sensitization using gold, sulfur and selenium, however, fog was greatly generated. On the other hand, in the emulsions of the present invention where a slight amount of silver chloride was deposited after the reduction sensitization and thereafter, third stage growing was performed, the sensitivity width was more increased and generation of fog could be remarkably prevented. Further, the change in the sensitivity after the storage under high temperature and high humidity conditions was also greatly improved.

EXAMPLE 2

Em-10 was prepared in the same manner as in Em-1 in Example 1. This emulsion was reduction-sensitized for 40 minutes by elevating the temperature to 60° C. and adding $1\times10^{-6}$ mol/mol-Ag of dimethylamineborane. After 4 minutes, one part (Em-10(a)) as it is, second part (Em-10(b)) after adding thereto silver chloride fine grains having a side length of 0.11 μm in an amount, as silver, of 5% of Em-10 and third part (Em-10(c)) after adding silver bromide fine grains having a-diameter of 0.06 μm in an amount, as silver, of 5% of Em-10 each was stirred at 60° C. for 30 minutes. Thereafter, $9\times10^{-4}$ mol/mol-Ag of anhydro-5-chloro-5'-phenyl-9-ethyl-3,3'-di(3-sulfopropyl) oxacarbocyaninehydroxide sodium salt as a sensitizing dye was added to each emulsion. Subsequently, the emulsions were processed in the same manner as in Example 1 to obtain coated Samples 10 to 12.

Fourth part (Em-10(d)) after adding thereto the sensitizing dye above and then adding the same silver chloride fine grains as used in the second part was stirred at 60° C for 30 minutes and subsequently processed in the same manner as in Example 1 to obtain Sample 13. In Em-10(d), distinct silver chloride epitaxial projections were observed in the vicinity of apexes of the octahedral grain. On the other hand, the surface of Em-10(b) was slightly uneven and no distinct epitaxial projection.

These samples each was exposed (1/100 sec) using a sensitometry through a yellow filter and then processed in the same manner as in Example 1. The results obtained are shown in Table 2. Taking the relative sensitivity immediately after the coating of Sample 10 as 100, the storability test was performed in the same manner as in Example 1.

TABLE 2

| | | Immediately after Coating | | Change Rate of Relative Sensitivity | |
|---|---|---|---|---|---|
| Sample | Em | Fog | Relative Sensitivity | after Storage at 45° C. and 75% RH | |
| 10 | 10-(a) | 0.04 | 100 | 48 | Comparison |
| 11 | 10-(b) | 0.04 | 118 | 81 | Invention |
| 12 | 10-(c) | 0.04 | 105 | 48 | Comparison |
| 13 | 10-(d) | 0.04 | 126 | 54 | Comparison |

As is apparent from the results of Table 2, in the emulsion of the present invention where silver chloride fine grain was deposited after completion of the reduction sensitization in a slight amount of not forming distinct epitaxial projections, the color sensitizing sensitivity was increased and at the same time, the storability under high temperature and high humidity conditions was remarkably improved.

On the other hand, in the case of Em-10(d) having distinct epitaxial projections, the ultimate sensitivity of the fresh emulsion was very high but the storability was scarcely improved.

EXAMPLE 3

Preparation of (Em-20):

To an aqueous solution prepared by dissolving 10 g of potassium bromide and 15 g of inactive gelatin having an average molecular weight of 15,000 in 3.7 λ of distilled water and under thorough stirring, a 14% aqueous potassium bromide solution and a 20% aqueous silver nitrate solution were added at a constant flow rate at 55° C. and pBr of 1.0 over 15 seconds by the double jet method (by this addition, 5.5% of entire silver amount was consumed; first stage). After 2 minutes, an aqueous gelatin solution (17%, 300 ml) was added and the mixed solution was stirred at 55° C. Thereafter, a 20% aqueous silver nitrate solution was added thereto at a constant flow rate until the pBr reached 1.4 (by this addition, 5.0% of the entire silver amount was consumed; second stage). Further, after 5 minutes, a 20% potassium iodobromide solution ($KBr_{1-x}I_x$, wherein x is 0.04) and a 33% aqueous silver nitrate solution were added over 43 minutes by the double jet method (by this addition, 25% of the entire silver amount was consumed; third stage). After 10 minutes, fine grain silver iodide emulsion corresponding to 4.6 g of silver nitrate was added and after 10 minutes, 14.5 ml of a 0.01 wt % aqueous $K_3IrCl_6$ solution was added. Thereafter, a mixed aqueous solution of 18% potassium bromide and 3% potassium iodide and a 33% aqueous silver nitrate solution were added over 39 minutes by the double jet method (by this addition, 64.5% of the entire silver amount was consumed; fourth stage). The amount of silver nitrate used in this emulsion was 425 g. Subsequently, the emulsion was desalted by the ordinary flocculation method. After the desalting, gelatin and water were added to adjust the pAg to 8.4 and the pH to 6.0, at 40° C. Thus, a tabular silver iodobromide emulsion-was prepared, where tabular grains having an aspect ratio of 5 or more accounted for 60% of the entire projected area, tabular grains having an aspect ratio of 2 or more accounted for 95% of the entire projected area, the average aspect ratio was 7.8, the coefficient of variation was 16% and the sphere-corresponding diameter was 0.7 μm. This emulsion was observed through a transmission-type electron microscope of 200 kV at a liquified $N_2$ temperature and found that grains having 50 dislocation lines per one grain accounted for 70%.

Preparation of (Em-21):

Em-21 was prepared in the same manner as in Em-20 except that in the preparation of Em-20, 8 m g of thiourea dioxide as a reduction sensitizer was added 1 minute before starting of the third stage and 102 mg of sodium benzenethiosulfonate was added immediately before the fourth stage.

Preparation of (Em-22):

Em-22 was prepared in the same manner as in Em-21 except that in the preparation of Em-21, a fine grain silver chloride emulsion (corresponding to 6 g of $AgNO_3$) having a side length of 0.11 μm was added 1 minute after completion of the third stage. Em-21 and Em-22 had almost the same shape as that of Em-20 and the integration form of dislocation lines was also the same among these emulsions.

These emulsions each was ripened for 45 minutes by adding chloroauric acid ($1.6\times10^{-5}$ mol/mol-Ag), sodium thiosulfate ($2.4\times10^{-5}$ mol/mol-Ag), pentafluorophenyldiphenylphosphine selenide ($1.4\times10^{-5}$ mol/mol-Ag) and potassium thiocyanate ($3\times10^{-3}$ mol/mol-Ag) after elevating the temperature to 56° C. and adding anhydro-5-chloro-5'-phenyl-9-ethyl-3,3'-di(3-sulfopropyl) oxacarbocyaninehydroxide sodium salt as a sensitizing dye.

Thereafter, the following additives were added to each emulsion:

Magenta coupler: 3-{3-[2-(2,4-di-tert-amylphenoxy) butyryl-amino]benzoylamino}-1-(2,4,6-trichlorophenyl) pyrazolin-5-one;

Oil: tricresyl phosphate;

Stabilizer: 4-hydroxy-6-methyl-1,3,3a,7-tetrazaindene;

Antifoggant: 1-(m-sulfophenyl)-5-mercaptotetrazole monosodium salt and 1-(p-carboxyphenyl)-5-mercaptotetrazole;

Coating aid: sodium dodecylbenzenesulfonate;

Hardening agent: 1,2-bis(vinylsulfonylacetylamino)ethane; and

Antiseptic: phenoxyethanol.

Then, each emulsion was coated on a triacetyl cellulose film support having an undercoat layer together with the gelatin protective layer containing polymethyl methacrylate fine particles by the co-extrusion method.

The samples obtained were exposed (1/100 second) using a sensitometry through a yellow filter and then processed through the color development described below.

After the processing, samples were determined on the density with a green filter and the results of the evaulation on the photographic capabilities are shown in Table 3. The relative sensitivity was a reciprocal of the exposure amount necessary for obtaining an optical density of (fog value +maximum density/2), relativized to the value of Sample 21 which was taken as 100.

TABLE 3

| | | Immediately after Coating | | Change Rate of Relative Sensitivity | |
|---|---|---|---|---|---|
| Sample | Em | Fog | Relative Sensitivity | after Storage at 50° C. and 75% RH | |
| 20 | Em-2 | 0.16 | 100 | 86 | Comparison |
| 21 | Em-21 | 0.21 | 128 | 71 | " |
| 22 | Em-22 | 0.17 | 131 | 85 | Invention |

(Processing Process)

| Step | Processing Time | Processing Temperature (° C.) |
|---|---|---|
| Color development | 2 min. 45 sec. | 38 |
| Bleaching | 6 min. 30 sec. | 38 |
| Water washing | 2 min. 10 sec. | 24 |
| Fixing | 4 min. 20 sec. | 38 |
| Water washing (1) | 1 min. 05 sec. | 24 |
| Water washing (2) | 1 min. 00 sec. | 24 |
| Stabilization | 1 min. 05 sec. | 38 |
| Drying | 4 min. 20 sec. | 55 |

Each processing solution had the following composition.

| | (unit: g) |
|---|---|
| (Color Developer) | |
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-Ethyl-N-β-hydroxyethylamino)-2-methylaniline sulfate | 4.5 |
| Water to make | 1.0 liter |
| pH | 10.05 |

-continued

| | (unit: g) |
|---|---|
| (Bleaching Solution) | |
| Sodium ethylenediaminetetraacetato ferrite trihydrate | 100.0 |
| Disodium ethylenediaminetetraacetate | 10.0 |
| Ammonium bromide | 140.0 |
| Ammonium nitrate | 30.0 |
| Aqueous ammonia (27%) | 6.5 ml |
| Water to make | 1.0 liter |
| pH | 6.0 |
| (Fixing Solution) | |
| Disodium ethylenediaminetetraacetate | 0.5 |
| Sodium sulfite | 7.0 |
| Sodium bisulfite | 5.0 |
| Aqueous solution of ammonium thiosulfate (70%) | 170.0 ml |
| Water to make | 1.0 liter |
| pH | 6.7 |
| (Stabilizing Solution) | |
| Formalin (37%) | 2.0 ml |
| Polyoxyethylene-p-monononylphenyl ether (average polymerization degree: 10) | 0.3 |
| Disodium ethylenediaminetetraacetate | 0.05 |
| Water to make | 1.0 liter |
| pH | 5.0–8.0 |

Further, the samples were stored for 3 days in an atmosphere of 50° C. and 70% RH and the ratio of change of the relative sensitivity was determined. The results are also shown in Table 3.

As is apparent from the results of Table 3, when the reduction sensitization was performed during the grain formation, the sensitivity immediately after the coating was increased but the ratio of change after the storage was large. On the other hand, when a small amount of silver chloride was deposited after the completion of reduction sensitization, the storage was improved while keeping the sensitivity.

EXAMPLE 4

Preparation of (Em-30):

To 0.75 λ of a 0.8% low molecular weight (molecular weight: 10,000) gelatin solution containing 0.25 mol of potassium bromide, 41 ml of 0.5 M silver nitrate solution and 41 ml of the same 0.5 M potassium bromide solution as above were added by the double jet method over 30 seconds while stirring. During this processing, the gelatin solution was kept at 40° C. Thus, nucleation was performed (first stage). The pH of the gelatin solution at the nucleation was 5.0.

After the nucleation, the potential was adjusted with KBr to have a pBr of 2.05 and thereafter, the temperature was elevated to 70° C. Then, 220 ml of a 10% deionized and alkali-processed ossein gelatin solution was added and the emulsion was ripened for 10 minutes.

Subsequently, 3.8 mg of thiourea dioxide was added and then 150 g of nitrate and a solution of potassium iodide and potassium bromide were added at an accelerated flow rate over 60 minutes by the controlled double jet method where the flow rate was controlled so that the final stage flow rate became 19 times the initial stage flow rate, while keeping the potation at 0 mV to grow the grains (second stage).

Thereafter, 52 mg of sodium ethylthiosulfonate was added, the temperature was lowered to 55° C., the pBr was adjusted to 1.5 with potassium bromide and 353 ml of a 1% potassium iodide solution was added. Then, 327 ml of a 0.5M silver nitrate solution and a 0.5M potassium bromide solution were added over 20 minutes at a potential of 0 mV by the controlled double jet method to form the shell (third stage). Subsequently, the emulsion was washed with water at 35° C. by the known flocculation method and dispersed by adding thereto gelatin.

To the thus-prepared emulsion, Comparative Sensitizing Dyes S-1, S-2 and S-3 were added each in an optimal amount, and then chemical sensitization was optimally performed by adding sodium benzenesulfonate, sodium thiosulfate, pentafluorophenyldiphenylphosphine selenide, sodium thiocyanate and chloroauric acid to prepare a tabular AgBrI (AgI=2.0 mol %) emulsion Em-30 in which the coefficient of variation of the diameter in terms of a circle having the same area as the projected area (hereinafter referred to as the "circle-corresponding diameter) was 15%, the circle-corresponding diameter was 1.2 $\mu$m and the average thickness was 0.13 $\mu$m.

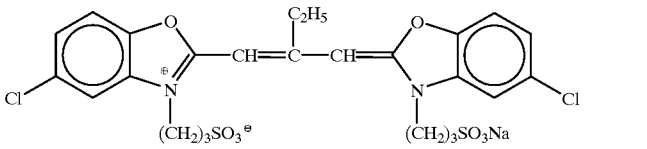

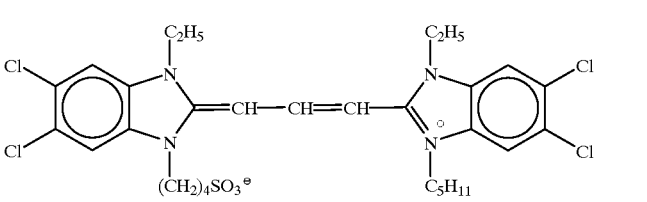

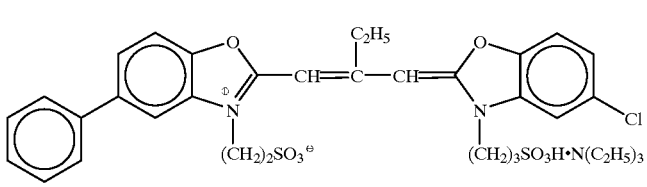

Preparation of (Em-31):

Em-31 was prepared thoroughly in the same manner as in Em-30 except that in the preparation of Em-30, the addition at the second stage was stopped after the addition was continued for 55 minutes, a silver chloride emulsion (corresponding to 3 g of $AgNO_3$) having a side length of 0.10 $\mu$m was added, the resulting emulsion was stirred for 10 minutes (at this time, gentle and rounded projections and recessions were slightly observed over the entire grain surface through an electron microscope), and the remaining addition-of the second stage was again continued. The emulsion obtained had almost the same shape as that of Em-30.

To each of the thus-prepared emulsions, the same additives as in Example 3 were added. Then, each emulsion was uniformly coated on a polyester support subjected to undercoating and thereon a surface protective layer mainly comprising an aqueous gelatin solution was coated to prepare coated samples.

The samples obtained were exposed and developed in the same manner as in Example 3 and then stored at 45° C. and 75% RH for 3 days. The results of evaluation on the photographic capabilities are shown in Table 4.

TABLE 4

| Sample | Em | Immediately after Coating: Fog | Immediately after Coating: Relative Sensitivity | Change Rate of Relative Sensitivity after Storage at 45° C. and 75% RH | |
|---|---|---|---|---|---|
| 30 | Em-30 | 0.14 | 100 | 82 | Comparison |
| 31 | Em-31 | 0.14 | 100 | 93 | Invention |

As is apparent from the results of Table 4, the emulsion subjected to the reduction sensitization according to the present invention was improved in the storability under high temperature and high humidity conditions.

While the invention has been described in detail and with reference to specific embodiments thereof, it will be apparent to one skilled in the art that various changes and modifications can be made therein without departing from the spirit and scope thereof.

What is claimed is:

1. A process for reduction-sensitizing a silver halide photographic emulsion, comprising reduction-sensitizing a silver halide basis grain having a silver bromide content of 75 mol % or more and thereafter or at the same time, depositing silver halide having a silver chloride content of 50 mol % or more on the surface of said basis grain not to have a distinct epitaxial form.

2. The process for reduction-sensitizing a silver halide photographic emulsion as claimed in claim 1, wherein said silver halide having a silver chloride content of 50 mol % or more covers 50% or more of the surface of said basis grain.

3. The process for reduction-sensitizing a silver halide photographic emulsion as claimed in claim 1, wherein said silver halide having a silver chloride content of 50 mol % or more occupies from 0.5 to 10 wt % of the entire silver amount.

4. The process for reduction-sensitizing a silver halide photographic emulsion as claimed in claim 1, wherein silver halide having a silver bromide content of 60 mol % or more is further deposited on said silver halide having a silver chloride content of 50 mol % or more.

5. The process for reduction-sensitizing a silver halide photographic emulsion as claimed in claim 1, wherein said basis grain is a tabular grain having an aspect ratio of 2 or more.

6. The process for reduction-sensitizing a silver halide photographic emulsion as claimed in claim 1, which comprises subjecting the silver halide photographic emulsion to the reduction sensitization and then to a selenium sensitization.

7. The process for reduction-sensitizing a silver halide photographic emulsion as claimed in claim 1, which comprises subjecting the silver halide photographic emulsion to the reduction sensitization and then to a selenium sensitization and a gold sensitization.

8. The process for reduction-sensitizing a silver halide photographic emulsion as claimed in claim 1, wherein said depositing step comprises depositing silver halide having a silver chloride content of 90 mol % or more on the surface of said basis grain not to have a distinct epitaxial form.

9. The process for reduction-sensitizing a silver halide photographic emulsion as claimed in claim 1, wherein said depositing step comprises depositing pure silver chloride on the surface of said basis grain not to have a distinct epitaxial form.

10. The process for reduction-sensitizing a silver halide photographic emulsion as claimed in claim 1, wherein said reduction-sensitizing step comprising reduction-sensitizing a pure silver bromide basis grain.

11. A silver halide photographic light-sensitive material comprising a support having thereon at least one layer containing a silver halide emulsion, wherein said emulsion is prepared by reduction-sensitizing a silver halide basis grain having a silver bromide content of 75 mol % or more and thereafter or at the same time, depositing silver halide having a silver chloride content of 50 mol % or more on the surface of said basis grain not to have a distinct epitaxial form.

12. The silver halide photographic light-sensitive material as claimed in claim 11, wherein said silver halide emulsion contains a silver halide tabular grain having at least 5 dislocation lines per one grain.

13. The silver halide photographic light-sensitive material as claimed in claim 11, wherein said emulsion is prepared by reduction-sensitizing a silver halide basis grain having a silver bromide content of 75 mol % or more and thereafter or at the same time, depositing silver halide having a silver chloride content of 90 mol % or more on the surface of said basis grain not to have a distinct epitaxial form.

14. The silver halide photographic light-sensitive material as claimed in claim 11, wherein said emulsion is prepared by reduction-sensitizing a silver halide basis grain having a silver bromide content of 75 mol % or more and thereafter or at the same time, depositing pure silver chloride on the surface of said basis grain not to have a distinct epitaxial form.

15. The silver halide photographic light-sensitive material as claimed in claim 11, wherein said emulsion is prepared by reduction-sensitizing a pure silver bromide basis grain and thereafter or at the same time, depositing silver halide having a silver chloride content of 50 mol % or more on the surface of said basis grain not to have a distinct epitaxial form.

* * * * *